US012789246B2

(12) United States Patent
Kim et al.

(10) Patent No.: US 12,789,246 B2
(45) **Date of Patent: *Nov. 10, 2026**

(54) HOT STAMPING COMPONENT

(71) Applicant: Hyundai Steel Company, Incheon (KR)

(72) Inventors: Hye Jin Kim, Incheon (KR); Jin Ho Lee, Incheon (KR); Je Youl Kong, Incheon (KR); Seung Chae Yoon, Incheon (KR); Seung Pill Jung, Incheon (KR); Hyun Yeong Jung, Incheon (KR); Kyu Yeon Hwang, Incheon (KR)

(73) Assignee: HYUNDAI STEEL COMPANY, Incheon (KR)

( * ) Notice: Subject to any disclaimer, the term of this patent is extended or adjusted under 35 U.S.C. 154(b) by 650 days.

This patent is subject to a terminal disclaimer.

(21) Appl. No.: 18/079,332

(22) Filed: Dec. 12, 2022

(65) Prior Publication Data

US 2023/0125659 A1 Apr. 27, 2023

Related U.S. Application Data

(63) Continuation of application No. PCT/KR2022/001495, filed on Jan. 27, 2022.

(30) Foreign Application Priority Data

Oct. 26, 2021 (KR) ..... 10-2021-0144000

(51) Int. Cl.

| | |
|---|---|
| ***C21D 9/46*** | (2006.01) |
| ***B21D 22/02*** | (2006.01) |
| ***C22C 38/00*** | (2006.01) |
| ***C22C 38/02*** | (2006.01) |
| ***C22C 38/04*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |

(52) U.S. Cl.

CPC ..... *B21D 22/022* (2013.01); *C21D 9/46* (2013.01); *C22C 38/002* (2013.01); *C22C 38/02* (2013.01); *C22C 38/04* (2013.01); *C22C 38/24* (2013.01); *C22C 38/26* (2013.01); *C22C 38/28* (2013.01); *C22C 38/32* (2013.01); *C21D 2211/001* (2013.01); *C21D 2211/008* (2013.01)

(58) Field of Classification Search

CPC ..... C22C 38/04

See application file for complete search history.

(56) References Cited

U.S. PATENT DOCUMENTS

| | | | | |
|---|---|---|---|---|
| 10,286,439 | B2 | 5/2019 | Jin et al. | |
| 11,420,247 | B2 | 8/2022 | Takashima et al. | |
| 11,566,311 | B2 | 1/2023 | Suzuki | |
| 12,378,651 | B2 | 8/2025 | Maeda et al. | |
| 2012/0118440 | A1 | 5/2012 | Nakanishi et al. | |
| 2013/0095347 | A1* | 4/2013 | Kawasaki | B21B 45/00 148/333 |
| 2017/0321294 | A1 | 11/2017 | Arlazarov et al. | |
| 2019/0309385 | A1 | 10/2019 | Yi et al. | |
| 2023/0132597 | A1* | 5/2023 | Yoo | C22C 38/32 420/84 |
| 2023/0138738 | A1* | 5/2023 | Kim | C22C 38/02 148/645 |

FOREIGN PATENT DOCUMENTS

| | | | |
|---|---|---|---|
| EP | 2436796 | A1 | 4/2012 |
| EP | 2581465 | A1 | 4/2013 |
| EP | 3483299 | A1 | 5/2019 |
| JP | 2006-152427 | A | 6/2006 |
| JP | 2010-150612 | A | 7/2010 |
| JP | 2018-003051 | A | 1/2018 |
| JP | 2019-14939 | A | 1/2019 |
| JP | 2022-13657 | A | 1/2022 |
| KR | 10-2018-0095757 | A | 8/2018 |
| KR | 10-2310966 | B1 | 10/2021 |
| KR | 10-2315388 | B1 | 10/2021 |
| WO | 2007/129676 | A1 | 11/2007 |
| WO | 2016/079565 | A1 | 5/2016 |
| WO | 2020/195012 | A1 | 10/2020 |
| WO | 2020/222394 | A1 | 11/2020 |
| WO | 2021/145442 | A1 | 7/2021 |

OTHER PUBLICATIONS

Office Action issued Apr. 9, 2024 in corresponding Japanese Patent Application No. 2022-575480.

Notification of Third Party Submission, issued Jul. 1, 2023 in corresponding Korean Application No. 10-2021-144000.

Extended European Search Report dated Aug. 1, 2025 for corresponding European Patent Application No. 22817504.8.

Office Action issued May 13, 2026 in corresponding Indian Patent Application No. 202417033546.

* cited by examiner

*Primary Examiner* — Jophy S. Koshy

(74) *Attorney, Agent, or Firm* — Fox Rothschild LLP

(57) ABSTRACT

The present invention provides a hot stamping component having a tensile strength of 1350 Mpa or greater, including a microstructure including prior austenite grains (PAG), wherein an average particle diameter of the PAGs is 35 μm or less.

3 Claims, 9 Drawing Sheets

(a) (b) (c)

(a) (b) (c)

HOT STAMPING COMPONENT

CROSS-REFERENCES TO RELATED APPLICATIONS

This Application is a continuation application of PCT/KR2022/001495 filed Jan. 27, 2022, which claims priority of Korean Patent Application 10-2021-0144000 filed on Oct. 26, 2021.

The entire contents of these applications are incorporated herein by reference in their entirety.

TECHNICAL FIELD

The present invention relates to a hot stamping component.

BACKGROUND

As environmental regulations and fuel economy regulations are strengthened around the world, the need for lighter vehicle materials is increasing. Accordingly, research and development on ultra-high-strength steel and hot stamping steel are being actively conducted. Among them, the hot stamping process consists of heating/forming/cooling/trimming, and uses the phase transformation of the material and the change of the microstructure during the process.

Recently, studies to improve delayed fracture, corrosion resistance, and weldability occurring in a hot stamping member manufactured by a hot stamping process have been actively conducted. As a related technology, there is Korean Application Publication No. 10-2018-0095757 (Title of the invention: Method of manufacturing hot stamping member).

SUMMARY

Technical Problem

Exemplary embodiments of the present invention provide a hot stamping component having improved resistance to hydrogen-induced stress corrosion cracking caused by a corrosion reaction.

However, these problems are exemplary, and the scope of the present invention is not limited thereto.

Technical Solution

According to one aspect of the present invention, provided is a hot stamping component having a tensile strength of 1350 Mpa or greater. The hot stamping component including a microstructure including prior austenite grains (PAG), and an average particle diameter of the PAGs is 35 μm or less.

In an exemplary embodiment, as a grain boundary forming the interface of the microstructure, the hot stamping component may include a low-angle grain boundary having a grain angle of 0 degrees or greater and 15 degrees or less and a high-angle grain boundary having a grain angle of greater than 15 degrees and 180 degrees or less, and a fraction of the low-angle grain boundary may be 20% or greater.

In an exemplary embodiment, the high angle grain boundary may include a special grain boundary having a regular atomic arrangement and a random grain boundary having an irregular atomic arrangement.

In an exemplary embodiment, a fraction of the special grain boundary may be 5% or greater and 10% or less.

In an exemplary embodiment, a fraction of the random grain boundaries may be 70% or less.

In an exemplary embodiment, the hot stamping component may include a martensite phase having an area fraction of 95% or greater in the hot stamping component.

In an exemplary embodiment, the hot stamping component may include a base steel plate, wherein the base steel sheet may include an amount of 0.19 wt % to 0.30 wt % of carbon (C), an amount of 0.10 wt % to 0.90 wt % of silicon (Si), an amount of 0.8 wt % to 1.8 wt % of manganese (Mn), an amount of 0.03 wt % or less of phosphorus (P), an amount of 0.015 wt % or less of sulfur (S), an amount of 0.1 wt % to 0.6 wt % of chromium (Cr), an amount of 0.001 wt % to 0.005 wt % of boron (B), an amount of 0.003 wt % or less of calcium (Ca), an amount of 0.1 wt % or less of the sum of one or more of titanium (Ti), niobium (Nb) and vanadium (V), the balance of iron (Fe), and other unavoidable impurities, based on the total weight of the base steel sheet.

Advantageous Effects

According to an exemplary embodiment of the present invention made as described above, hot stamping component with improved hydrogen-induced stress corrosion cracking resistance can be realized. Of course, the scope of the present invention is not limited by these effects.

DETAILED DESCRIPTION

Figure 1:
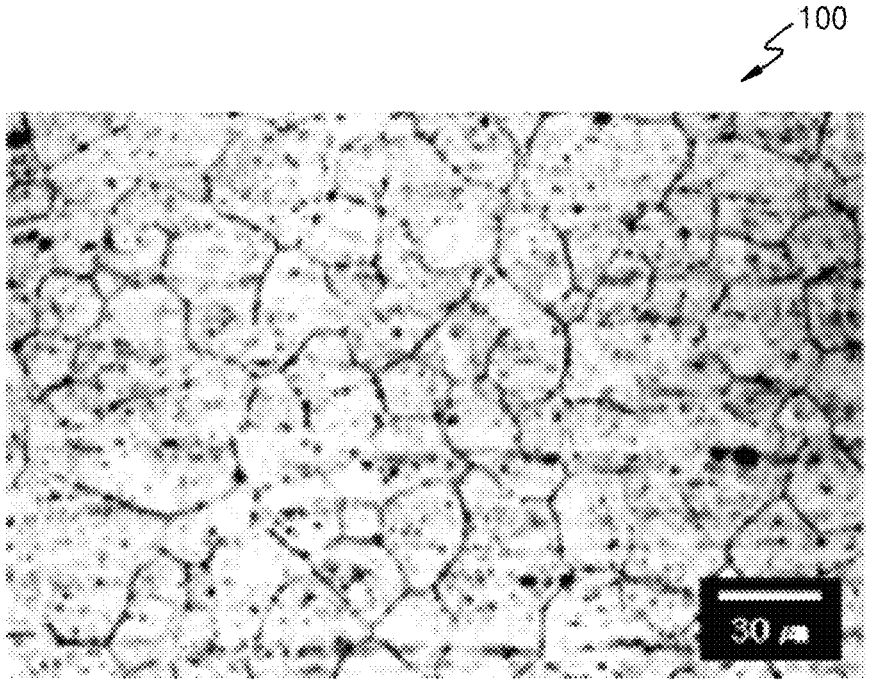
FIG. 1 shows an enlarged image of a portion of a cross section of a hot stamping component according to an exemplary embodiment of the present invention.

Because the present invention may apply various transformations and may have various embodiments, specific embodiments are illustrated in the drawings and described in detail in the detailed description. Effects and features of the present invention, and a method for achieving them, will become apparent with reference to the embodiments described below in detail in conjunction with the drawings.

However, the present invention is not limited to the embodiments disclosed below and may be implemented in various forms.

Hereinafter, embodiments of the present invention will be described in detail with reference to the accompanying drawings, and when described with reference to the drawings, the same or corresponding components are given the same reference numerals, and the overlapping description thereof will be omitted.

In the present specification, terms such as first, second, etc. are used for the purpose of distinguishing one component from another without limiting meaning.

In the present specification, the singular expression includes the plural expression unless the context clearly dictates otherwise.

In the present specification, the terms include or have means that the features or components described in the specification are present, and the possibility that one or more other features or components may be added is not excluded in advance.

In the present specification, when it is said that a portion such as a film, region, or component is on or on another portion, it includes not only the case where it is directly on the other portion, but also the case where another film, region, component, etc. is interposed therebetween.

In the present specification, when a film, region, or component is connected, this includes cases in which films, regions, and components are directly connected, and/or cases in which other films, regions, and components are interposed between the films, regions, and components to be indirectly connected. For example, in the present specification, when it is said that a film, region, component, etc. is electrically connected, it refers to a case in which a film, region, or component is directly electrically connected and/or a case in which another film, region, or component is interposed therebetween is indirectly electrically connected.

In the present specification, "A and/or B" refers to A, B, or A and B. And, "at least one of A and B" represents the case of A, B, or A and B.

In the present specification, the x-axis, y-axis, and z-axis are not limited to the three axes of the Cartesian coordinate system, and may be interpreted in a broad sense including them. For example, the x-axis, y-axis, and z-axis may be orthogonal to each other, but may refer to different directions that are not orthogonal to each other.

In the present specification, in cases where certain embodiments are otherwise practicable, a specific process sequence may be performed different from the described sequence. For example, the two processes described in succession may be performed substantially simultaneously, or may be performed in an order opposite to the described order.

In the drawings, the size of the components may be exaggerated or reduced for convenience of description. For example, because the size and thickness of each component shown in the drawings are arbitrarily indicated for convenience of description, the invention is not necessarily limited to what is shown.

FIG. 1 shows an enlarged image of a portion of a cross section of a hot stamping component according to an exemplary embodiment of the present invention.

Referring to FIG. 1, the hot stamping component 100 according to an exemplary embodiment of the present invention may have a tensile strength of 1350 MPa or greater and a yield strength of 900 MPa or greater. A base steel sheet and a plating layer covering at least one surface of the base steel sheet may be included.

The plating layer may include, for example, aluminum (Al). In this case, the plating layer may include aluminum-iron (Al—Fe) and aluminum-iron-silicon (Al—Fe—Si) compounds by mutual diffusion of Fe of a base steel sheet 100 and Al of the plating layer.

The base steel sheet may be a steel sheet manufactured by performing a hot rolling process and/or a cold rolling process on a slab cast to include a predetermined amount of a predetermined alloy element. In an exemplary embodiment, the base steel sheet may include carbon (C), silicon (Si), manganese (Mn), phosphorus (P), sulfur (S), chromium (Cr), boron (B) and the balance of iron (Fe), and other unavoidable impurities. In addition, optionally, the base steel sheet may further include at least one of titanium (Ti), niobium (Nb), and vanadium (V) as an additive. In addition, optionally, the base steel sheet may further include a predetermined amount of calcium (Ca).

In more detail, the base steel sheet may include an amount of 0.19 wt % to 0.30 wt % of carbon (C), an amount of 0.1 wt % to 0.6 wt % of silicon (Si), an amount of 0.8 wt % to 1.8 wt % of manganese (Mn), an amount of 0.03 wt % or less of phosphorus (P), an amount of 0.015 wt % or less of sulfur (S), an amount of 0.10 wt % to 0.60 wt % of chromium (Cr), an amount of 0.001 wt % to 0.005 wt % of boron (B), and the balance of iron (Fe) and other unavoidable impurities. In addition, optionally, the base steel sheet may include a total in an amount of 0.1 wt % or less of at least one of titanium (Ti), niobium (Nb), and vanadium (V). In addition, optionally, the base steel sheet may contain 0.003 wt % or less of calcium (Ca).

The carbon (C) functions as an austenite stabilizing element in the base steel sheet. The carbon is a main element that determines the strength and hardness of the base steel sheet, and is added for the purpose of securing tensile strength (e.g., tensile strength of 1,350 MPa or greater) and hardenability of the base steel sheet after the hot stamping process. Such carbon may be included in an amount of 0.19 wt % to 0.30 wt % based on the total weight of the base steel sheet. When the carbon content is less than 0.19 wt %, it is difficult to secure a hard phase (martensite, etc.) and thus it is difficult to satisfy the mechanical strength of the base steel sheet. Conversely, when the carbon content exceeds 0.30 wt %, problems of brittleness or reduction in bending performance of the base steel sheet may be caused.

Silicon (Si) functions as a ferrite stabilizing element in the base steel sheet. The silicon (Si), as a solid-solution strengthening element, improves ductility of a base steel sheet and enhances the carbon concentration in austenite by suppressing the formation of low-temperature carbides. In addition, the silicon is a key element for hot rolling, cold rolling, hot press structure homogenization (perlite, manganese segregation zone control) and ferrite microdispersion. The silicon acts as a martensitic strength heterogeneity control element and serves to improve impact performance. The silicon may be included in an amount of 0.1 wt % to 0.9 wt % based on the total weight of the base steel sheet. When the content of silicon is less than 0.1 wt %, it is difficult to obtain the above-mentioned effect, cementite formation and coarsening may occur in the final hot stamping martensite structure, the uniformity effect of the base steel sheet is insignificant, and the V-bending angle may not be secured. Conversely, when the content of silicon exceeds 0.9 wt %, hot-rolled and cold-rolled loads increase, hot-rolled red scale is excessive, and plating characteristics of the base steel sheet may be deteriorated.

Manganese (Mn) functions as an austenite stabilizing element in the base steel sheet. The manganese is added for the purpose of increasing hardenability and strength during heat treatment. The manganese may be included in an amount of 0.8 wt % to 1.8 wt % based on the total weight of the base steel sheet. When the content of manganese is less than 0.8 wt %, the crystal grain refinement effect is not sufficient, and thus the hard phase fraction in the molded article after hot stamping may be insufficient due to insufficient hardenability. On the other hand, when the content of manganese exceeds 1.8 wt %, ductility and toughness may be deteriorated due to segregation of manganese or pearlite band, and it may cause in bending performance and a heterogeneous microstructure may occur.

Phosphorus (P) may be included in an amount greater than 0 wt % and 0.03 wt % or less based on the total weight of the base steel sheet in order to prevent deterioration in toughness of the base steel sheet. When the content of phosphorus exceeds 0.03 wt %, iron phosphide compounds are formed, resulting in deterioration in toughness and weldability, and cracks may be induced in the base steel sheet during the manufacturing process.

Sulfur (S) may be included in an amount greater than 0 wt % and 0.015 wt % or less based on the total weight of the base steel sheet. When the sulfur content exceeds 0.015 wt %, hot workability, weldability and impact properties are deteriorated, and surface defects such as cracks may occur due to the formation of large inclusions.

Chromium (Cr) is added for the purpose of improving hardenability and strength of the base steel sheet. The chromium enables crystal grain refinement and strength through precipitation hardening. The chromium may be included in an amount of 0.1 wt % to 0.6 wt % based on the total weight of the base steel sheet. When the chromium content is less than 0.1 wt %, the precipitation hardening effect is low, and on the contrary, when the chromium content exceeds 0.6 wt %, the amount of Cr-based precipitates and matrix solids increases, resulting in a decrease in toughness and an increase in production cost due to an increase in cost.

Boron (B) is added for the purpose of securing hardenability and strength of the base steel sheet by suppressing ferrite, pearlite, and bainite transformations to secure a martensite structure. In addition, the boron is segregated at grain boundaries to lower grain boundary energy to increase hardenability, and has an effect of grain refinement by increasing austenite grain growth temperature. The boron may be included in an amount of 0.001 wt % to 0.005 wt % based on the total weight of the base steel sheet. When the boron is included in the above range, it is possible to prevent grain boundary brittleness in the hard phase and to secure high toughness and bendability. When the boron content is less than 0.001 wt %, the hardenability effect is insufficient, and on the contrary, when the boron content exceeds 0.005 wt %, the solid solubility is low, and due to its low solid solubility, it may be easily precipitated at the grain boundary depending on heat treatment conditions, resulting in deterioration of quenchability or high-temperature embrittlement, and toughness and bendability may be lowered due to grain boundary brittleness in the hard phase.

The additive is a carbide generating element that contributes to the formation of precipitates in a steel sheet 10. In detail, the additive may include at least one of titanium (Ti), niobium (Nb), and vanadium (V). The titanium, niobium, and vanadium may be included in an amount greater than 0.1 wt % based on the total weight of the base steel sheet.

The titanium (Ti) may be added for the purpose of strengthening hardenability and improving the material by forming precipitates after hot press heat treatment. In addition, formation of precipitated phases such as Ti (C, N) at high temperatures effectively contributes to the refinement of austenite grains. When titanium is included in the above content range, it is possible to prevent poor performance and coarsening of precipitates, easily secure physical properties of steel materials, and prevent defects such as cracks on the surface of steel materials. On the other hand, when the content of titanium is out of the range, the precipitate may be coarsened, resulting in a decrease in elongation and bendability.

Niobium (Nb) and vanadium (V) are added for the purpose of increasing strength and toughness according to a decrease in martensite packet size. In addition, when niobium and vanadium are included in the above range, the crystal grain refinement effect of the steel material is excellent in the hot rolling and cold rolling process, and it is possible to prevent cracking of slabs and brittle fractures of products during steelmaking/casting, and to minimize the generation of coarse precipitates in steelmaking.

Calcium (Ca) may be added to control the shape of the inclusions. The calcium may be included in an amount of 0.003 wt % or less based on the total weight of the base steel sheet.

The base steel sheet according to the present embodiment may be a steel sheet manufactured by performing a hot rolling process and/or a cold rolling process on a slab cast to include a predetermined amount of a predetermined alloy element. Such a base steel sheet may exist as a full austenite structure at a hot stamping heating temperature, and may transform into a martensite structure upon cooling thereafter. The martensite phase is the result of the diffusionless transformation of austenite y below the onset temperature (Ms) of martensitic transformation during cooling.

The hot stamping component 100 may include a prior austenite grain (PAG) as a microstructure. In an exemplary embodiment, the base steel sheet may include a martensite phase of 95% or greater in area fraction. The PAG may be generally distributed within the martensite phase.

On the other hand, when the hot stamping component 100 is exposed to a corrosive environment such as crevice corrosion, a hydrogen-induced stress corrosion cracking in which cracks propagate along grain boundaries from the surface where hydrogen (H) generated during the corrosion reaction is fractured by tensile stress may occur. Resistance to such hydrogen-induced stress corrosion cracking may be improved by controlling the size of the PAG.

Accordingly, in the hot stamping component 100 according to the present embodiment, the average size of the PAG may be 35 μm or less, more specifically, 5 μm or greater and 35 μm or less. When the average size of the PAG is formed to be 5 μm or greater and 35 μm or less, resistance to hydrogen-induced stress corrosion cracking may be improved in the same stress and corrosion environment. Forming the average size of the PAG to be less than 5 μm is practically impossible in the hot stamping process involving the heat treatment process, and when the average size of the PAG is coarsened beyond 35 μm, hydrogen easily penetrates and diffusible hydrogen moving along the grain boundary increases, so that cracks are easily propagated along the hydrogen movement path. In addition, as the density of hydrogen present along the grain boundary increases, the probability of hydrogen-induced delayed fracture may increase.

The average size of the PAG may be controlled by adjusting the hot stamping process time and temperature. In an exemplary embodiment, the hot stamping process is performed by multi-stage heating, and the temperature range of the heating furnace during the hot stamping process may be 750° C. to 1,000° C. In addition, in an exemplary embodiment, during the hot stamping process, the total soaking time in the heating furnace may be 150 seconds to 550 seconds. When the hot stamping process is performed under the above conditions, it is possible to form the average size of the PAG to 35 μm or less, more specifically, 5 μm to 35 μm. A related hot stamping process will be described later in detail with reference to FIGS. 5 and 6.

Figure 2:
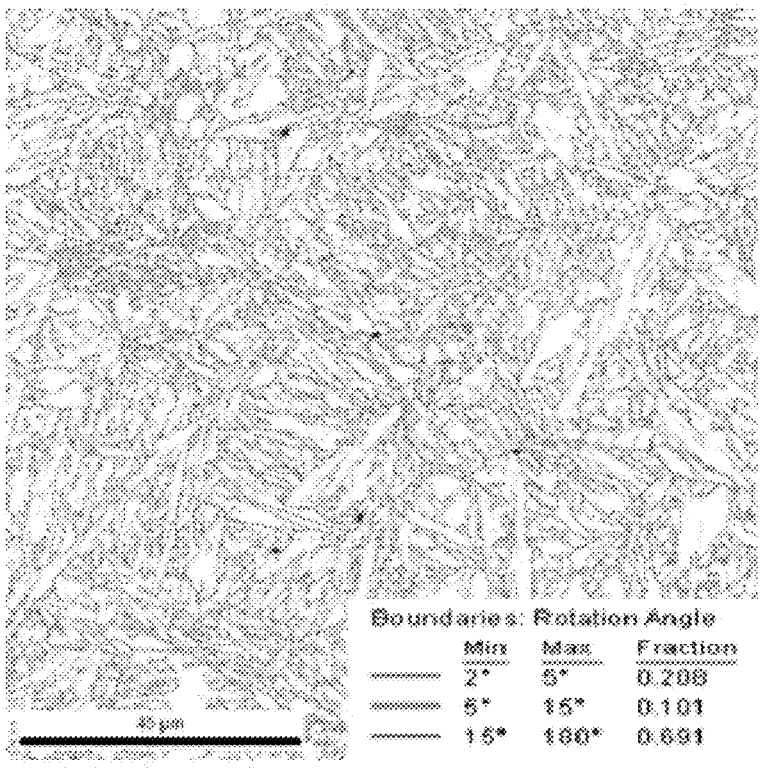
FIG. 2 shows an electron backscattered diffraction (EBSD) analysis image of a hot stamping component according to an exemplary embodiment of the present invention.
Figure 3:
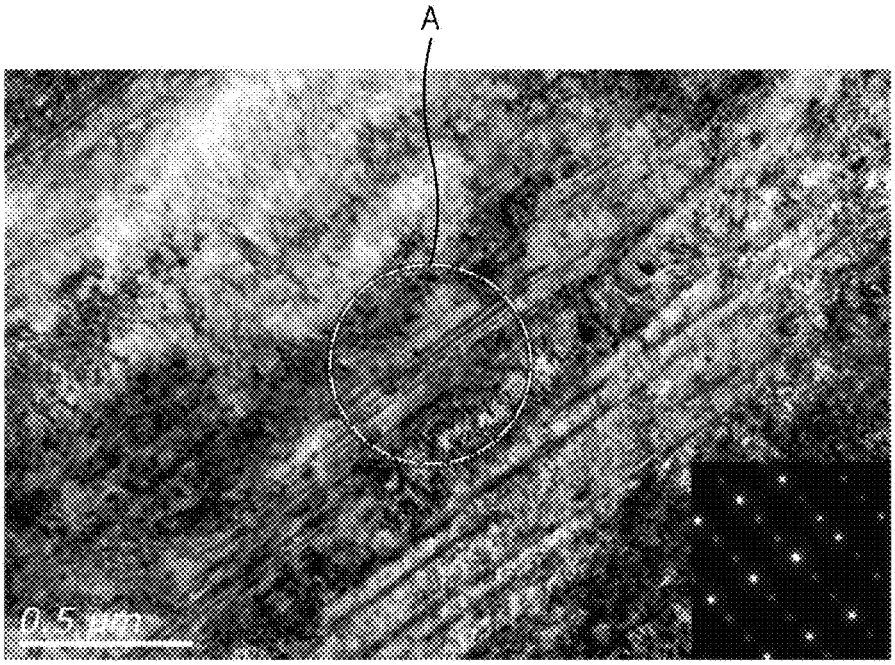
FIG. 3 shows an enlarged image of a portion of a cross section of a hot stamping component according to an exemplary embodiment of the present invention.
Figure 4:
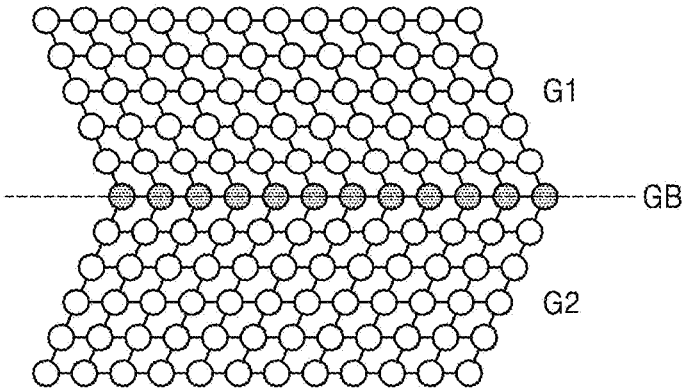
FIG. 4 shows a view showing a state in which the microstructure of a hot stamping component according to an exemplary embodiment of the present invention forms a special grain boundary.

FIG. 2 is an electron backscattered diffraction (EBSD) analysis image of a hot stamping component according to an exemplary embodiment of the present invention, FIG. 3 is an enlarged image of a portion of a cross section of a hot stamping component according to an exemplary embodiment of the present invention, and FIG. 4 is a view showing a state in which the microstructure of a hot stamping component according to an exemplary embodiment of the present invention forms a special grain boundary.

The martensite phase according to an exemplary embodiment of the present invention includes a plurality of characteristic microstructural units. For example, the microstructure in the martensite phase may have a fine and complicated shape in which the PAGs, packets, and laths hierarchically overlap. Here, the lath has a rod shape oriented in parallel in a specific direction, and the packet may be defined as an area composed of a group of laths. Packets and laths may be included within the PAG.

The microstructures in the hot stamping component 100 form grain boundaries that form interfaces between the microstructures. Here, the crystal grain boundary (or grain boundary) may refer to a boundary having a low atomic density where two or more microstructures having different directions are in contact. In the present invention, grain boundaries may mean interfaces between the PAGs, interfaces between packets, and interfaces between laths.

In this embodiment, the grain boundary of the microstructure in the hot stamping component 100 may include a low-angle grain boundary having a small grain angle and a high-angle grain boundary having a relatively large grain angle. The low-angle grain boundary may refer to a grain boundary in which an angle between two microstructures in contact with each other based on the interface is 0 degrees or greater and 15 degrees or less, and the high-angle grain boundary may refer to a grain boundary in which an angle between two microstructures in contact with each other based on the interface is greater than 15 degrees and less than 180 degrees.

Referring to FIG. 2, the low-angle grain boundary and the high-angle grain boundary may be measured through EBSD analysis. In FIG. 2, red and green lines represent low-angle grain boundaries with grain angles of 15 degrees or less, and blue lines represent high-angle grain boundaries with grain angles greater than 15 degrees and 180 degrees or less.

In an exemplary embodiment, the hot stamping component 100 may include 20% or greater of low-angle grain boundaries having a grain angle of 0 degrees or greater and 15 degrees or less, and the hot stamping component 100 may include a high-angle grain boundary having a grain angle of greater than 15 degrees and less than 180 degrees in a fraction of 80% or less. A large grain angle means that the energy of the grain boundary is high, and conversely, a low grain angle means that the energy of the grain boundary is low. Because grain boundaries with high energy act as nucleation sites for solid-phase reactions such as diffusion, phase transformation, the higher the energy of grain boundaries, the easier it is to activate diffusive hydrogen within the steel sheet, and such diffusible hydrogen is vulnerable to stress corrosion cracking and may spread the propagation of cracks. Therefore, in the hot stamping component 100 according to an exemplary embodiment of the present invention, as 20% or greater of low-inclination grain boundaries having relatively low energy are secured in fraction, it is possible to effectively prevent crack propagation by reducing the hydrogen diffusion path.

In an exemplary embodiment, the hot stamping component 100 may include a high-angle grain boundary having a grain angle of greater than 15 degrees and less than 180 degrees in a fraction of 80% or less. These high angle grain boundaries may include a special grain boundary and a random grain boundary. The random grain boundary is a grain boundary having an irregular arrangement of atoms, and is a relatively unstable interface due to high energy of the grain boundary. Cracks in the hot stamping component 100 generally proceed along such an unstable interface, and therefore, in order to prevent the hot stamping component 100 from being fractured by corrosion, it is required to control the random grain boundary to a certain ratio or less.

Accordingly, the hot stamping component 100 according to an exemplary embodiment may include 70% or less of random grain boundaries among high-angle grain boundaries having a grain angle of greater than 15 degrees and less than 180 degrees. When the random grain boundaries are distributed over 70%, the interface energy between the microstructures in the hot stamping component 100 increases, which may act as a hydrogen diffusion path and a crack propagation path. Therefore, by controlling the random grain boundary to 70% or less, the unstable interface between the microstructures in the hot stamping component 100 is reduced to a certain ratio or less, thereby preventing hydrogen in the steel sheet from being activated as diffusible hydrogen.

In addition, the hot stamping component 100 may include 5% to 10% of special grain boundaries among high angle grain boundaries. FIG. 3 is an enlarged image of the lath structure among the microstructures of the hot stamping component 100 according to the present embodiment, and particularly, it may be confirmed that special grain boundaries appeared in the A portion.

In more detail, a special crystal grain boundary is a grain boundary with a special structure called a twinning boundary or coherent Σ3 boundary, and refers to a phenomenon in which two microstructures are symmetrically attached with a plane or axis interposed therebetween. In general, high-angle grain boundaries are randomly generated, but regular atomic arrangements may appear in some structures by diffusion through a heat treatment process such as an annealing process. Due to the regularity of atomic arrangement such as this symmetrical shape, the twin interface is placed in a matched state. It functions as a stable hydrogen trap site for diffusible hydrogen and effectively serves as a stable site for crack propagation, so that it is possible to effectively reduce the embrittlement mechanism.

FIG. 4 shows the inter-particle arrangement of special grain boundary. In FIG. 4, the atomic arrangement of the first crystal grain G1 and the second crystal grain G2 that are in contact with each other around the grain boundary GB is shown. In this case, the grain boundary GB formed by the first crystal grains G1 and the second crystal grains G2 may be an interface between lath-lath, an interface between lath-packet, or an interface between packet-packet. The atoms constituting the first crystal grain G1 and the atoms constituting the second crystal grain G2 may be symmetrically formed forming a matching interface as shown in FIG. 4. Grain angles according to the arrangement of atoms of the first and second crystal grains G1 and G2 may be classified as a high-angle grain boundary forming an obtuse angle, but the energy of the grain boundary GB may be formed to be remarkably low, unlike a random grain boundary. This is because the atoms of the special grain boundary are provided to have a stable arrangement along the grain boundary GB. Therefore, these special grain boundaries have low energy and act as trap sites for diffusible hydrogen, thereby reducing the movement of hydrogen and preventing crack propagation. For example, these special grain boundaries may be distributed over about 90% at interfaces between lath-lath, lath-packet, or packet-packet.

The hot stamping component 100 according to an exemplary embodiment of the present invention includes an amount of 5% to 10% of the special grain boundary as a fraction, so that the hydrogen introduced during hydrogen-induced stress corrosion cracking is trapped in the special grain boundary, thereby increasing the hydrogen trapping effect and effectively blocking the movement of diffusible hydrogen. In addition, by providing a fraction of special grain boundaries among the high-angle grain boundaries in the hot stamping component 100 in the range of 5% to 10%, the fraction of random grain boundaries having high energy interfaces may be relatively reduced.

In the method of manufacturing a hot stamping component according to an exemplary embodiment of the present invention, a multi-stage heating method is employed in a heating furnace when heating for hot stamping. Hereinafter, a method of manufacturing a hot stamping component according to an exemplary embodiment of the present invention will be described in detail with reference to FIGS. 5 and 6.

Figure 5:
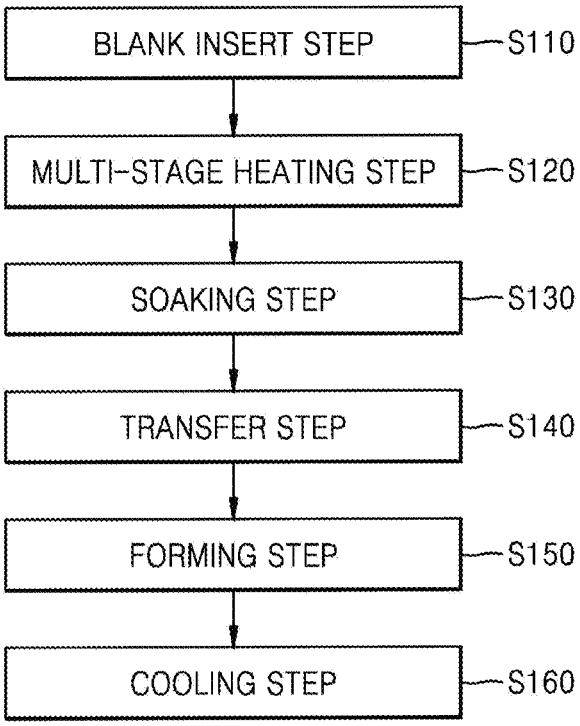
FIG. 5 shows a flowchart schematically illustrating a method of manufacturing a hot stamping component according to an exemplary embodiment of the present invention.
Figure 6:
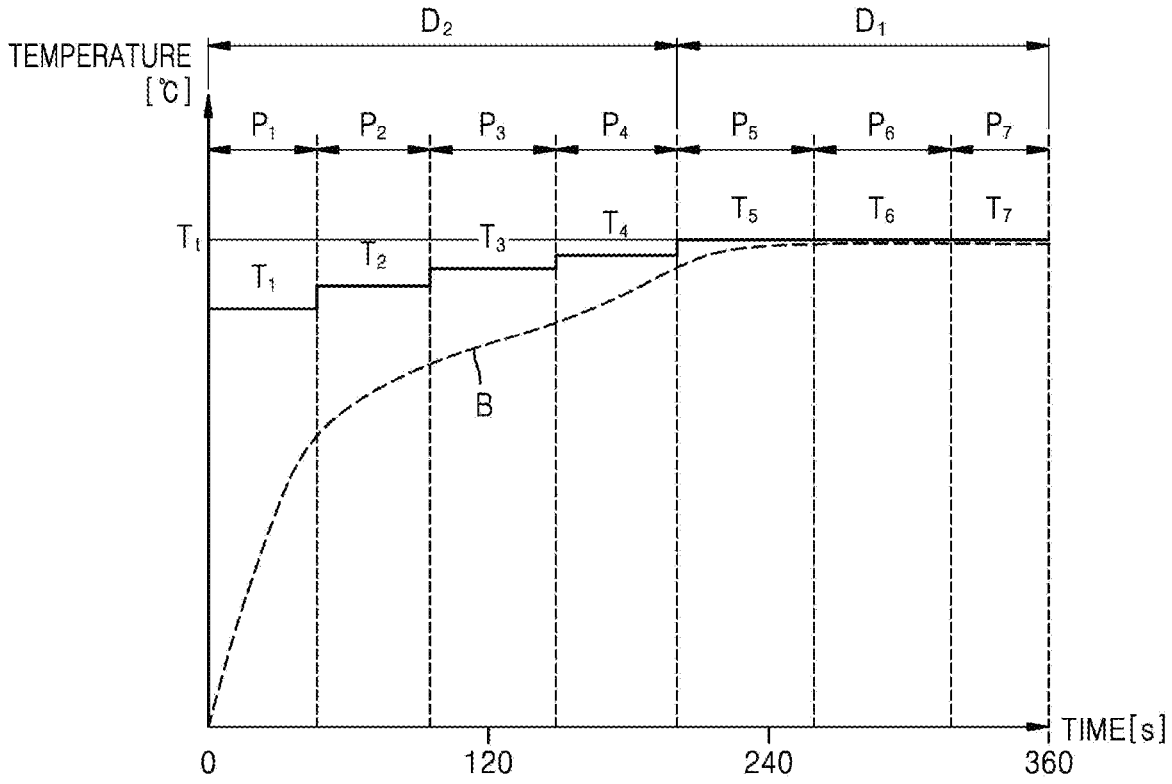
FIG. 6 shows a view for explaining the blank heating operation of FIG. 5.

FIG. 5 shows a flowchart schematically illustrating a method of manufacturing a hot stamping component according to an exemplary embodiment of the present invention, and FIG. 6 is a view for explaining the blank heating operation of FIG. 5.

Referring to FIG. 5, the manufacturing method of a hot stamping component according to an exemplary embodiment of the present invention may include a blank insert step S110, a multi-stage heating step S120, and a soaking step S130, and may further include a transfer step S140, a forming step S150, and a cooling step S160, after the soaking step S130.

First, the blank insert step S110 may be a step of inserting blanks into a heating furnace having a plurality of sections having different temperature ranges.

The inserting the blank into the heating furnace may be formed by cutting a plate material for forming a hot stamping component. The plate material may be manufactured through a process of performing hot rolling or cold rolling on a steel slab and then annealing heat treatment. In addition, after the annealing heat treatment, a plating layer may be formed on at least one surface of the plate material subjected to the annealing heat treatment.

The inserting the blank into the heating furnace may be transported along the conveying direction after being mounted on the rollers.

After the blank insert step S110, a multi-stage heating step S120 may be performed. The multi-stage heating step S120 may be a step in which the blank is heated in stages while passing through a plurality of sections provided in the heating furnace. In the multi-stage heating step S120, the heating furnace according to an exemplary embodiment may include a plurality of sections having different temperature ranges. In more detail, as shown in FIG. 6, the heating furnace may include a first section $P_1$ having a first temperature range $T_1$, a second section $P_2$ having a second temperature range $T_2$, a third section $P_3$ having a third temperature range $T_3$, a fourth section $P_4$ having a fourth temperature range $T_4$, a fifth section $P_5$ having a fifth temperature range $T_5$, a sixth period $P_6$ having a sixth temperature range $T_6$, and a seventh period $P_7$ having a seventh temperature range $T_7$.

The first section $P_1$ to the seventh section $P_7$ may be sequentially disposed in the heating furnace. The first section $P_1$ having the first temperature range $T_1$ may be adjacent to the inlet of the heating furnace into which the blank is inserted, and the seventh section $P_7$ having the seventh temperature range $T_7$ may be adjacent to the outlet of the heating furnace in which the blank is discharged. Therefore, the first section $P_1$ having the first temperature range $T_1$ may be the first section of the heating furnace, and the seventh section $P_7$ having the seventh temperature range $T_7$ may be the last section of the heating furnace. As will be described below, among the plurality of sections of the heating furnace, the fifth section $P_5$, the sixth section $P_6$, and the seventh section $P_7$ may be sections in which soaking is performed instead of sections in which multi-stage heating is performed.

Temperatures of a plurality of sections provided in the heating furnace, for example, the temperature of the first section $P_1$ to the seventh section $P_7$ may increase in a direction from an inlet of the heating furnace into which blanks are inserted to an outlet of the heating furnace where the blank is taken out. However, the temperature of the fifth section $P_5$ to the seventh section $P_7$ may be the same. In addition, a temperature difference between two sections adjacent to each other among a plurality of sections provided in the heating furnace may be greater than 0° C. and less than 100° C. For example, a temperature difference between the first section $P_1$ and the second section $P_2$ may be greater than 0° C. and less than 100° C.

In an exemplary embodiment, the first temperature range $T_1$ of the first section $P_1$ may be 840° C. to 860° C., or 835° C. to 865° C. The second temperature range $T_2$ of the second section $P_2$ may be 870° C. to 890° C., or 865° C. to 895° C. The third temperature range $T_3$ of the third section $P_3$ may be 900° C. to 920° C., or 895° C. to 925° C. The fourth temperature range $T_4$ of the fourth section $P_4$ may be 920° C. to 940° C., or 915° C. to 945° C. The fifth temperature range $T_5$ of the fifth period $P_5$ may be Ac3 to 1,000° C. Preferably, the fifth temperature range $T_5$ of the fifth period $P_5$ may be 930° C. or higher and 1,000° C. or less. More preferably, the fifth temperature range $T_5$ of the fifth period $P_5$ may be 950° C. or higher and 1,000° C. or less. The sixth temperature range T6 of the sixth period $P_6$ and the seventh temperature range $T_7$ of the seventh period $P_7$ may be the same as the fifth temperature range $T_5$ of the fifth period P5.

The soaking step S130 may be performed after the multi-stage heating step S120. The soaking step S130 may be a step of uniformly heating the blank to a temperature of Ac3 or higher in the last section among a plurality of sections provided in the heating furnace.

The soaking step S130 may be performed at the last section of a plurality of sections of the heating furnace. For example, the soaking step S130 may be performed in the fifth section $P_5$, the sixth section $P_6$, and the seventh section $P_7$ of the heating furnace. When a plurality of sections are provided in the heating furnace, there may be a problems such as temperature change in the section when the length of one section is long. Therefore, the section in which the soaking step S130 is performed is divided into a fifth section $P_5$, a sixth section $P_6$, and a seventh section $P_7$, and the fifth section $P_5$, the sixth section $P_6$ and the seventh section $P_7$ may have the same temperature range within the heating furnace.

In the soaking step S130, the multi-stage heated blank may be soaked at a temperature of Ac3 or higher. Preferably, in the soaking step S130, the multi-stage heated blank may be soaked at a temperature of 930° C. to 1,000° C. More preferably, in the soaking step S130, the multi-stage heated blank may be soaked at a temperature of 950° C. to 1,000° C. In an atmosphere exceeding 1,000° C., there may be a risk that beneficial carbides in the steel are dissolved into the base material and the effect of grain refinement is lost.

In an exemplary embodiment, the heating furnace may have a length of 20 m to 40 m along the transport path of the blank. The heating furnace may have a plurality of sections having different temperature ranges, and the ratio of the length $D_1$ of a section in which the blank is heated in multiple sections among the plurality of sections and the length $D_2$ of the section in which the blank is soaked among the plurality of sections may satisfy 1:1 to 4:1. In other words, the length $D_2$ of the soaking section among the plurality of sections provided in the heating furnace may have a length of 20% to 50% of the total length $D_1+D_2$ of the heating furnace.

For example, among the plurality of sections, a section in which the blank is soaked may be the last part of the heating furnace (e.g., the fifth section P5, the sixth section P6, and the seventh section P7). When the length of the section in which the blank is soaked increases and the ratio of the length D1 of the section in which the blank is heated in multiple stages D1 and the length D2 in the section in which the blank is soaked exceeds 1:1, an austenite (FCC) structure may be formed in the soaking section and hydrogen penetration into the blank may increase, resulting in increased delayed fracture. In addition, when the length of the section in which the blank is soaked is reduced and the ratio of the length of the section $D_1$ in which the blank is multi-stage heated and the length of the section $D_2$ in which the blank is soaked is less than 4:1, the soaking section (time) is not sufficiently secured, and thus the strength of the component manufactured by the manufacturing process of the hot stamping component may be non-uniform.

In an exemplary embodiment, in the multi-stage heating step S120 and the soaking step S130, the blank may have a heating rate of about 6° C./s to 12° C./s, and the soaking time may be about 3 minutes to 6 minutes. In more detail, when the thickness of the blank is about 1.6 mm to 2.3 mm, the heating rate is about 6° C./s to 9° C./s, and the soaking time may be about 3 minutes to 4 minutes. In addition, when the thickness of the blank is about 1.0 mm to 1.6 mm, the heating rate may be about 9° C./s to 12° C./s, and the soaking time may be about 4 minutes to 6 minutes.

On the other hand, after the soaking step S130, the transfer step S140, the forming step S150, and the cooling step S160 may be further performed.

The transfer step S140 may be a step of transferring the soaked blank from the heating furnace to the press mold. In the step of transferring the soaked blank from the heating furnace to the press mold, the soaked blank may be air-cooled for 5 seconds to 20 seconds.

The forming step S150 may be a step of forming a molded body by hot stamping the transferred blank. The cooling step S160 may be a step of cooling the formed molded body.

After being molded into a final component shape in a press mold, a final product may be formed by cooling the molded body. A cooling channel through which a refrigerant circulates may be provided in the press mold. The heated blank may be quenched by circulation of the refrigerant supplied through the cooling channel provided in the press mold. In this case, in order to prevent the spring back phenomenon of the plate material and to maintain the desired shape, rapid cooling may be performed while pressurizing with the press mold closed. In forming and cooling the heated blank, it may be cooled at an average cooling rate of at least 10° C./s or greater to the end temperature of martensite. The blank may be held for 3 seconds to 20 seconds in the press mold. When the holding time in the press mold is less than 3 seconds, sufficient cooling of the material is not performed, and thermal deformation occurs due to the residual heat of the product and the temperature deviation of each part, and thus the dimensional quality may be deteriorated. In addition, when the holding time in the press mold exceeds 20 seconds, the holding time in the press mold becomes long, which may decrease productivity.

In an exemplary embodiment, the hot stamping component manufactured by the method for manufacturing hot stamping component described above may have a tensile strength of 1,350 MPa or greater, preferably a tensile strength of 1,350 MPa or greater and less than 1,680 MPa, and may include a structure of martensite with an area fraction of 95% or greater. In addition, the hot stamping component manufactured by the above-described hot stamping component manufacturing method are formed with an average PAG size of 5 μm or greater and 35 μm or less, may have a fraction of low-angle grain boundaries of 20% or greater, and may be provided with a fraction of special grain boundaries of 5% to 10% among high-angle grain boundaries. When the hot stamping component satisfies the aforementioned range, it is possible to sufficiently secure resistance to hydrogen-induced stress corrosion cracking.

Hereinafter, the present invention will be described in more detail through examples and comparative examples. However, the following examples are intended to explain the present invention in more detail, and the scope of the present invention is not limited by the following examples. The following examples may be appropriately modified or changed by a person skilled in the art within the scope of the present invention.

<Manufacture of Hot Stamping Component>

A hot stamping component according to an exemplary embodiment of the present invention may include a base steel sheet having the component system of Table 1. A plating layer by hot-dip plating may be formed on the base steel sheet. The plating layer may include Al—Si—Fe. In the case of hot stamping component having the component system of Table 1, the tensile strength may be 1350 MPa or greater and the yield strength may be 900 MPa or greater.

TABLE 1

| Ingredients (wt %) | | | | | | | | |
|---|---|---|---|---|---|---|---|---|
| C | Si | Mn | P | S | N | Cr | Ti | B |
| 0.23 | 0.22 | 1.1 | 0.015 | 0.004 | 0.0005 | 0.2 | 0.035 | 0.0025 |

<Stress Corrosion Cracking Test of Hot Stamping Component>

As shown in Table 2 below, the average size of prior austenite, the fraction of low-sharp grain boundaries, and the fraction of special grain boundaries were measured for each of examples and comparative examples, respectively. In addition, stress corrosion cracking fracture results according to the corresponding examples and comparative examples were measured.

The stress corrosion cracking (SCC) property evaluation method was measured by exposing a specimen to which bending stress (100% yield strength) was applied by a 4-point bending test to a composite corrosion test.

The cyclic corrosion test (CCT) is an experiment to find out the transition state of a material found in a corrosion situation in a natural state, and measures hydrogen-induced cracking of steel materials by arbitrarily forming a wet, acidic atmosphere. In more detail, it was performed for cycles (720 hours) as one cycle, by immersing in salt water for about 5 hours at a temperature of 40° C. and a humidity of 95% RH (Step 1) and then forcibly drying under the conditions of a temperature of 70° C. and a humidity of 30% RH for about 2 hours (Step 2), exposing to a humid environment with a temperature of 50° C. and a humidity of 95% RH for about 3 hours (step 3), and finally, forcibly drying for about 2 hours under a temperature of 60° C. and a humidity of 30% RH (step 4).

TABLE 2

| example | prior austenite average size (μm) | low-angle grain boundary fraction (Vol. %) | special grain boundary fraction (Vol. %) | stress corrosion crack fracture results |
|---|---|---|---|---|
| Example 1 | 21 | 32 | 7.5 | not fractured |
| Example 2 | 25 | 34 | 6.2 | not fractured |
| Example 3 | 28 | 28 | 6 | not fractured |
| Example 4 | 30 | 21.3 | 8 | not fractured |
| Example 5 | 35 | 20.8 | 9 | not fractured |
| Example 6 | 5 | 20.9 | 5 | not fractured |
| Comparative example 1 | 38 | 15 | 1 | fracture |
| Comparative example 2 | 41 | 19 | 1 | fracture |
| Comparative example 3 | 51 | 14 | 2 | fracture |

As disclosed in Table 2, in the case of examples 1 to 6, the average size of PAGs is formed to be 35 μm or less, in more detail, 5 μm or greater and 35 μm or less, the fraction of low-angle grain boundaries was measured to be 20% or greater, and the fraction of special grain boundaries among high-angle grain boundaries was measured to be 5% to 10%. On the other hand, in comparative examples 1 to 3, it may be seen that the average size of the PAGs, the fraction of low-angle grain boundaries, and the fraction of special grain boundaries among the high-angle grain boundaries were all out of the above ranges. As a result, it may be seen that examples 1 to 6 satisfying the above range were not fractured during stress corrosion cracking evaluation, whereas comparative examples 1 to 3 outside the above range were fractured during stress corrosion cracking evaluation.

According to the above experimental results, it may be seen that the PAG average size is formed to be 35 μm or less, in more detail, 5 μm or greater and 35 μm or less, and in the case of the hot stamping component of the present invention in which the fraction of low-angle grain boundaries is 20% or greater and the fraction of special grain boundaries among high-angle grain boundaries is 5% to 10%, the resistance to stress corrosion cracking due to hydrogen diffusion is improved in the same stress and corrosion environment.

Figure 7:
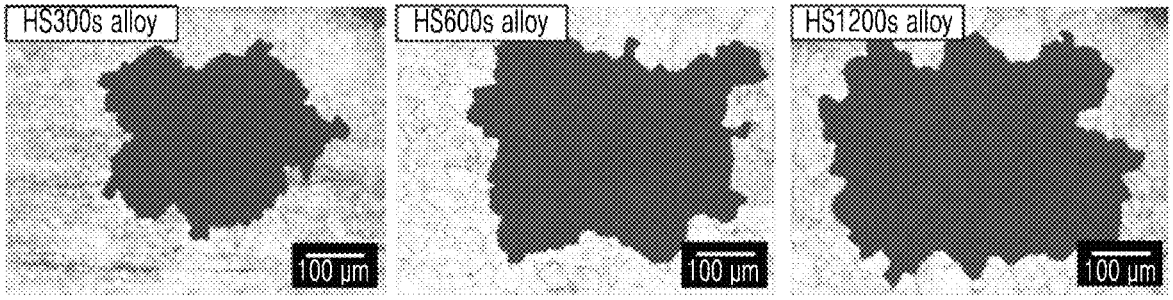
FIG. 7 shows images obtained by measuring the size of prior austenite grains in hot stamping components according to the manufacturing process time of hot stamping components.
Figure 8:
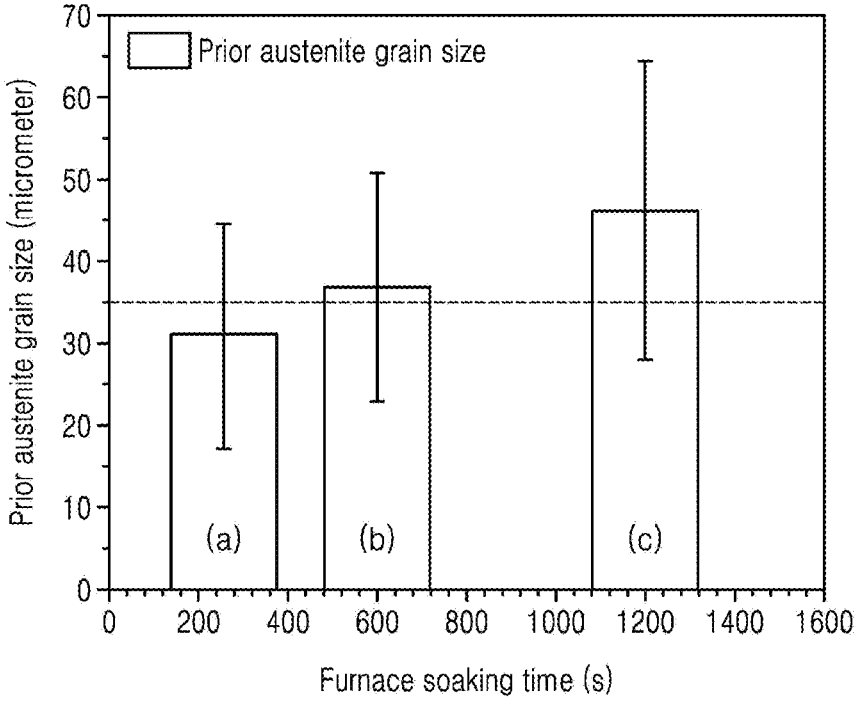
FIG. 8 shows a graph illustrating prior austenite grain sizes of examples and comparative examples of FIG. 7.
Figure 9:
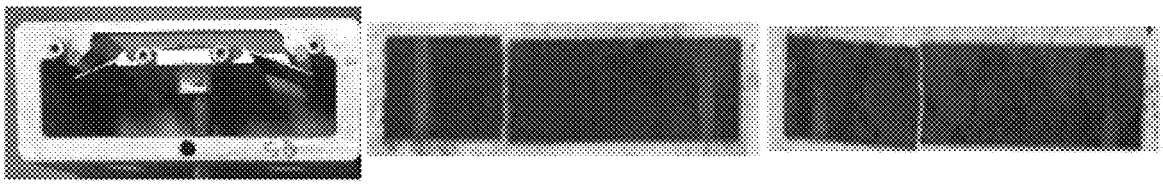
FIG. 9 shows images showing the results of a 4-point bending test for each of examples and comparative examples.

FIG. 7 is images of measuring the PAG size in a hot stamping component according to the total soaking time in the heating furnace, FIG. 8 is a graph illustrating PAG sizes of examples and comparative examples of FIG. 7, and FIG. 9 are images showing the results of a 4-point bending test for each of examples and comparative examples.

Referring to FIGS. 7 and 8, it may be seen that the PAG size in the hot stamping component varies depending on the total soaking time in the heating furnace. As an exemplary embodiment of the present invention, (a) shows a case where the total soaking time of the blank in the heating furnace is 300 seconds. (b) and (c) are comparative examples, showing cases where the total soaking time of the blank in the heating furnace was 600 seconds and 1,200 seconds, and other conditions were set the same. According to the manufacturing method of hot stamping component described with reference to FIGS. 5 and 6, the total soaking time in the heating furnace may be controlled to 180 seconds to 550 seconds.

In the case of (a), the average size of the PAGs was 28 μm, in the case of (b), the average size of the PAGs was 37 μm, and in the case of (c), the average size of the PAGs was measured to be 45 μm. That is, in (a), it may be seen that the average size of the PAGs was formed within the scope of the exemplary embodiment of the present invention, and in (b) and (c), it may be seen that the average size of the PAGs exceeds the critical value of 35 μm in the present invention, so that they are out of the range of the embodiment of the present invention.

As a result, during the stress corrosion cracking test as shown in FIG. 9, it was confirmed that the fracture occurred under the same conditions in the case of (b) and (c), while the case of (a) was not fractured.

The present invention has been described with reference to the exemplary embodiments shown in the drawings, but this is only exemplary, and those skilled in the art will understand that various modifications and other equivalent embodiments are possible therefrom. Therefore, the true technical scope of protection of the present invention should be determined by the technical idea of the appended claims.

The invention claimed is:

1. A hot stamping component having a tensile strength of 1350 MPa or greater, the hot stamping component comprising:

a microstructure comprising prior austenite grains (PAGs), wherein an average particle diameter of the PAGs is greater than 6 μm and 35 μm or less, as a grain boundary forming the interface of the microstructure, including a low-angle grain boundary having a grain angle of 0 degrees or greater and 15 degrees or less and a high-angle grain boundary having a grain angle of greater than 15 degrees and 180 degrees or less, wherein a fraction of the low-angle grain boundary is 20% or greater, wherein the high-angle grain boundary includes a special grain boundary having a regular atomic arrangement and a random grain boundary having an irregular atomic arrangement, wherein a fraction of the special grain boundary is 5% or greater and 10% or less, and wherein the hot stamping component comprises a base steel sheet including an amount of 0.19 wt % to 0.30 wt % of carbon (C), an amount of 0.10 wt % to 0.90 wt % of silicon (Si), an amount of 0.8 wt % to 1.8 wt % of manganese (Mn), an amount of 0.03 wt %/o or less of phosphorus (P), an amount of 0.015 wt % or less of sulfur(S), an amount of 0.1 wt % to 0.6 wt % of chromium (Cr), an amount of 0.001 wt % to 0.005 wt % of boron (B), an amount of 0.003 wt % or less of calcium (Ca), an amount of 0.1 wt % or less of a sum of one or more of titanium (Tl), niobium (Nb), and vanadium (V), the balance of iron (Fe), and other unavoidable impurities, based on the total weight of the base steel sheet.

2. The hot stamping component of claim 1, wherein a fraction of the random grain boundaries is 70% or less.

3. The hot stamping component of claim 1, comprising a martensite phase having an area fraction of 95% or greater in the hot stamping component.

* * * * *